United States Patent [19]

Broadbent

[11] Patent Number: 4,916,768

[45] Date of Patent: Apr. 17, 1990

[54] WASHING AND EXTRACTING METHOD

[75] Inventor: John Broadbent, Bloomingdale, Ill.

[73] Assignee: Ellis Corporation, Itasca, Ill.

[21] Appl. No.: 346,567

[22] Filed: May 2, 1989

Related U.S. Application Data

[62] Division of Ser. No. 130,311, Dec. 8, 1987, Pat. No. 4,856,301.

[51] Int. Cl.[4] ..... D06F 33/02

[52] U.S. Cl. ..... 8/159

[58] Field of Search ..... 8/159; 68/12 R, 24, 68/148, 152, 153, 171, 172

[56] References Cited

U.S. PATENT DOCUMENTS

| | | | |
|---|---|---|---|
| Re. 23,065 | 12/1948 | Ellis | 68/140 |
| 1,400,977 | 12/1921 | Perry | 68/210 |
| 1,611,895 | 12/1926 | Dienner | 68/140 X |
| 1,856,168 | 5/1932 | Perry | 68/210 |
| 2,115,072 | 4/1938 | Hunt et al. | 51/163.1 X |
| 2,165,884 | 7/1939 | Chamberlin et al. | 8/159 |
| 2,540,717 | 2/1951 | Diether | 68/24 X |
| 2,556,490 | 6/1951 | Chamberlin | 8/159 |
| 2,695,103 | 11/1954 | Armstrong | 68/24 X |
| 3,066,521 | 12/1962 | Gillessen | 68/148 X |
| 3,135,093 | 6/1964 | Hoffman, III . | |
| 3,172,277 | 3/1965 | Burkland | 68/24 X |
| 3,187,524 | 6/1965 | Wolverton | 68/24 |
| 3,197,983 | 8/1965 | Ilmer | 68/24 |
| 3,321,941 | 5/1967 | Ellis | 68/24 |
| 3,359,762 | 12/1967 | Lornitzo | 68/24 |
| 3,381,939 | 5/1968 | Brown et al. . | |
| 3,388,410 | 6/1968 | Marshall | 68/24 |
| 3,405,483 | 10/1968 | Boniface . | |
| 3,407,635 | 10/1968 | Beebe et al. | 68/207 |
| 3,417,582 | 12/1968 | Hertig et al. | 68/210 |
| 3,417,583 | 12/1968 | Hutterer | 68/210 |
| 3,566,627 | 3/1971 | McAnich et al. | 68/24 |
| 3,667,707 | 6/1972 | Mui | 248/638 X |
| 3,712,090 | 1/1973 | Toth et al. | 68/210 |
| 3,896,642 | 7/1975 | Toth | 68/210 |
| 4,513,464 | 4/1985 | Rettich et al. | 8/159 |

FOREIGN PATENT DOCUMENTS

| | | | |
|---|---|---|---|
| 2146351 | 3/1973 | Fed. Rep. of Germany . | |
| 54-119770 | 9/1979 | Japan . | |
| 2129838 | 5/1984 | United Kingdom | 68/24 |
| 2136601 | 9/1984 | United Kingdom . | |

*Primary Examiner*—Philip R. Coe

*Attorney, Agent, or Firm*—Mason, Kolehmainen, Rathburn & Wyss

[57] ABSTRACT

A washing and extracting machine includes a programmable controller for controlling a variable speed drive to control and vary the speed and direction of a rotating laundry cylinder containing a load of materials to be laundered. The cylinder is first loaded and then driven to rotate in a predetermined manner during a washing phase, followed by a rinsing phase and is then accelerated to a relatively high speed for extracting liquid from the laundered materials in an extracting phase. The laundry cylinder is accelerated and/or decelerated in accordance with a changeable, predefined acceleration/deceleration profile so that the laundry materials are movable radially and circumferentially in the cylinder in a controlled manner substantially eliminating unbalanced loading of the cylinder and contents during the washing, rinsing and extracting phases, thus eliminating the need for costly and complex shock mounting systems for supporting the rotating cylinder.

11 Claims, 7 Drawing Sheets

10
12
12A
12B
12D
14
14A
15
17
19
20
20A
21
22
23
23A
24
25
26
28
30
36
36A
38
40
42
44
46
48
50
52
54
56
58
60
62
82
84
A
B

WASHING AND EXTRACTING METHOD

RELATED APPLICATION

This application is a division of copending United States patent application Ser. No. 130,311, filed Dec. 8, 1987, and now U.S. Pat. No. 4,856,301, which copending application is assigned to the same assignee as the present application.

BACKGROUND OF THE INVENTION

1. Field of the Invention

The present invention relates to a new and improved washing and extracting machine for laundering various materials on a commercial basis. More particularly, the new and improved washing and extracting machine of the present invention is especially designed and constructed to include a programmable controller for selectively controlling the speed of a laundering cylinder during a washing, rinsing and extracting phase in accordance with a predefined acceleration/deceleration profile so that the contents of the cylinder are adjusted and maintained to insure the balanced loading therein for eliminating extensive and bulky shock loading mounts for the rotating cylinder that were heretofore required in prior art machines.

2. Background of the Prior Art

Over the years, a wide variety of commercial laundering machines have been developed, including washing machines, dryers and combination washing and extracting machines. The following U.S. patents disclose various prior art machines that have been developed. Perry U.S. Pat. No. 1,400,977; Dienner U.S. Pat. No. 1,611,895; Perry U.S. Pat. No. 1,856,168; Hunt, et al. U.S. Pat. No. 2,115,072; Ellis U.S. Pat. No. Re.23,065; Armstrong U.S. Pat. No. 2,695,103; Ilmer U.S. Pat. No 3,197,983; Ellis U.S. Pat. No. 3,321,941; Lornitzo U.S. Pat. No. 3,359,762; Boniface U.S. Pat. No. 3,405,483; Beebe, et al. U.S. Pat. No. 3,407,635; Herteg, et al. U.S. Pat. No. 3,417,582; Hutterer U.S. Pat. No. 3,417,583; Mui U.S. Pat. No. 3,667,707; Toth U.S. Pat. No. 3,712,090; Toth U.S. Pat. No. 3,896,642; and Fesmire U.S. Pat. No. 4,479,371.

SUMMARY OF THE INVENTION

It is an important object of the present invention to provide a new and improved washing and extracting machine for use with a plurality of different types of laundry materials. Other principal objects of the invention are to provide such washing and extracting machine including a programmable controller for controlling a variable speed drive in accordance with a predefined acceleration/deceleration profile that is selectively provided corresponding to a particular one of a plurality of different types of laundry material; to provide such washing and extracting machine wherein the dynamic forces exerted by the machine on a supporting base or structure are minimized; to provide a new and improved washing and extracting machine of the character described wherein a wide variety of different types of laundry materials can be effectively and efficiently laundered; and to provide such washing and extracting machine wherein after a low speed washing and rinsing phase is completed a laundering cylinder is emptied of washing liquid and further liquid is extracted from the materials contained within the cylinder by high speed centrifugal action without encountering substantial dynamic loads because of uneven placement of the materials within the cylinder.

Yet another associated object of the invention is to provide a new and improved washing and extracting machine of the character described wherein the laundry materials are able to move both radially and circumferentially in a controlled manner in a laundering cylinder during acceleration/deceleration washing, rinsing and extracting phase under a preprogrammed control so that a substantilly uniform loading of materials is provided around the entire circumference or periphery of the cylinder to thereby reduce any unbalanced load during high speed rotation.

In brief, the above and other objects and advantages of the present invention are provided by a new and improved washing and extracting machine for use with a plurality of different types of laundry materials. A laundering cylinder is mounted for rotation about a central axis for centrifugally moving the laundry material and a variable speed, hydraulically powered drive is provided for rotating the cylinder. A programmable controller is provided to control the variable speed drive during a washing, rinsing and extracting phase in accordance with predefined, variable acceleration/deceleration profiles. The predefined acceleration/deceleration profiles are selectively controllable to correspond to a particular one of many different types of laundry materials to provide a highly efficient laundry operation.

BRIEF DESCRIPTION OF THE DRAWING

The above and other objects and advantages of the present invention will become apparent upon consideration of the following detailed description taken in conjunction with the drawing wherein.

DESCRIPTION OF A PREFERRED EMBODIMENT

Figure 1:
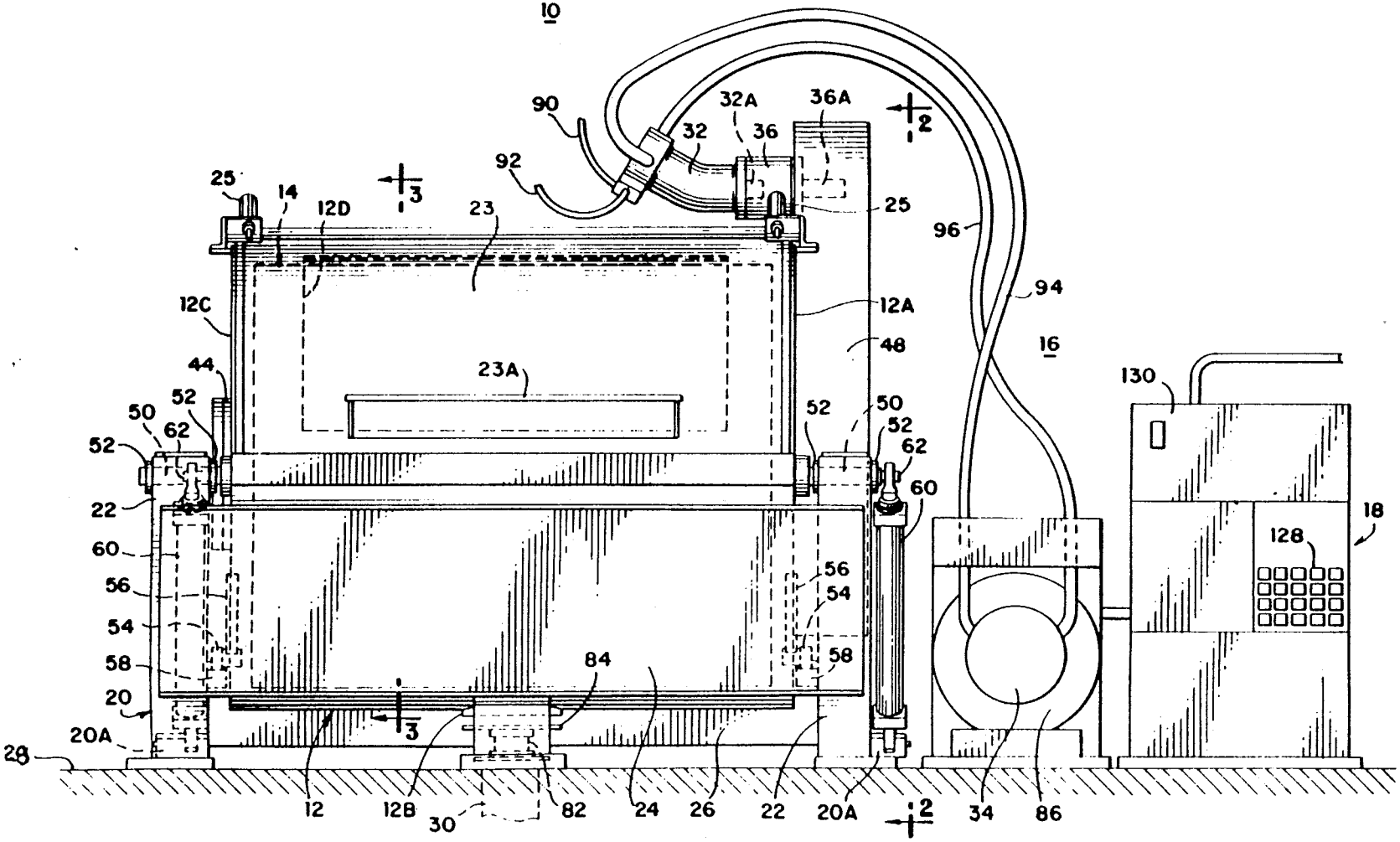
FIG. 1 is an elevational view of a new and improved washing and extracting machine constructed in accordance with the features of the present invention.

Referring now to FIG. 1, there is illustrated a new and improved combination washing and extracting machine 10 constructed in accordance with the features of the present invention. The machine 10 is designed to launder a wide variety of different materials and after the completion of a washing and rinsing phase, to extract most of the liquid from the laundry materials.

As its major components, the washing and extracting machine 10 includes a cylindrical, horizontally extending outer cylinder or housing 12 and an inner, perforated, rotor drum or laundering cylinder 14 mounted for rotation about a horizontal central axis A within the housing 12. The washing and extracting machine 10 includes a hydraulic drive system 16 for rotating the laundering cylinder 14 and a programmable controller 18 for receiving input selections by the user operator and for controlling the operation of the machine 10.

Figures 2, 3:
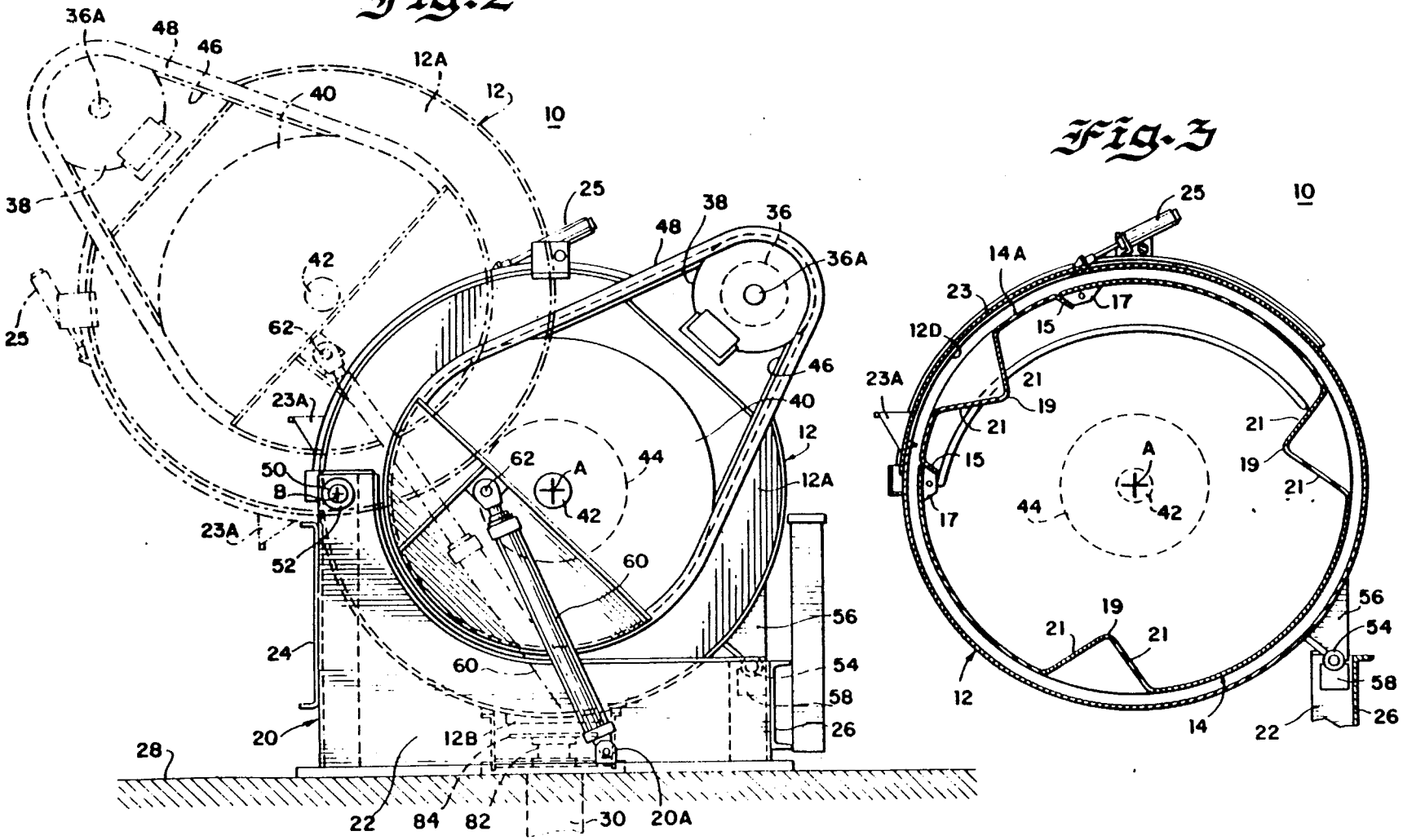
FIG. 2 is a cross-sectional view taken substantially along lines 2—2 of FIG. 1.
FIG. 3 is a cross-sectional view taken substantially along lines 3—3 of FIG. 1.
Figure 5A:
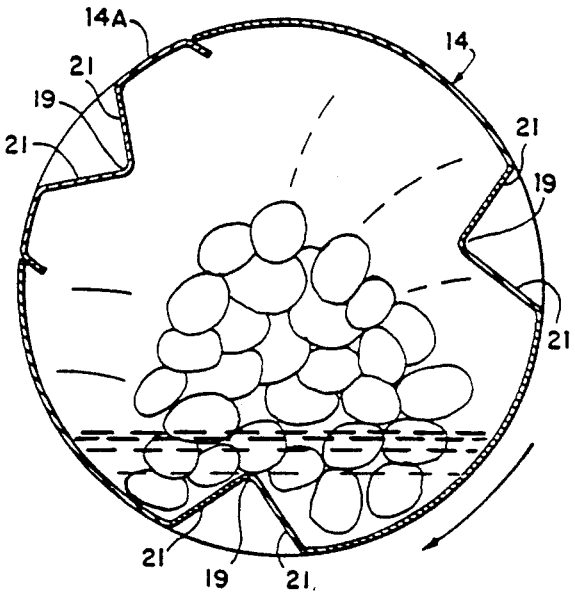
FIGS. 5A–5F are graphical representations to illustrate washing, rinsing and extracting phases of the washing and extracting machine in accordance with the present invention.
Figure 5B:
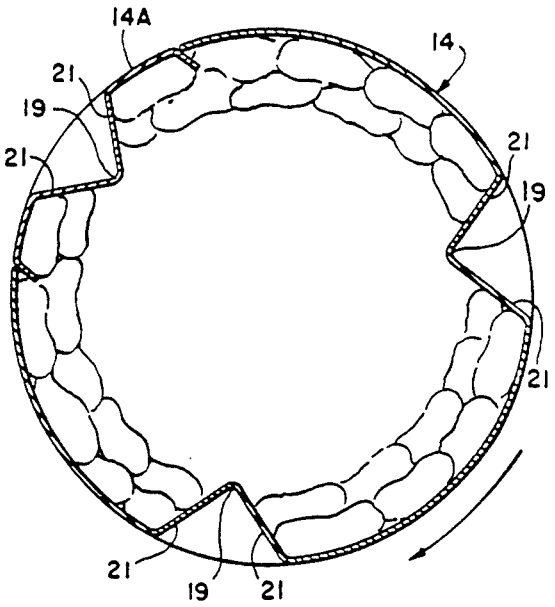
Figure 5C:
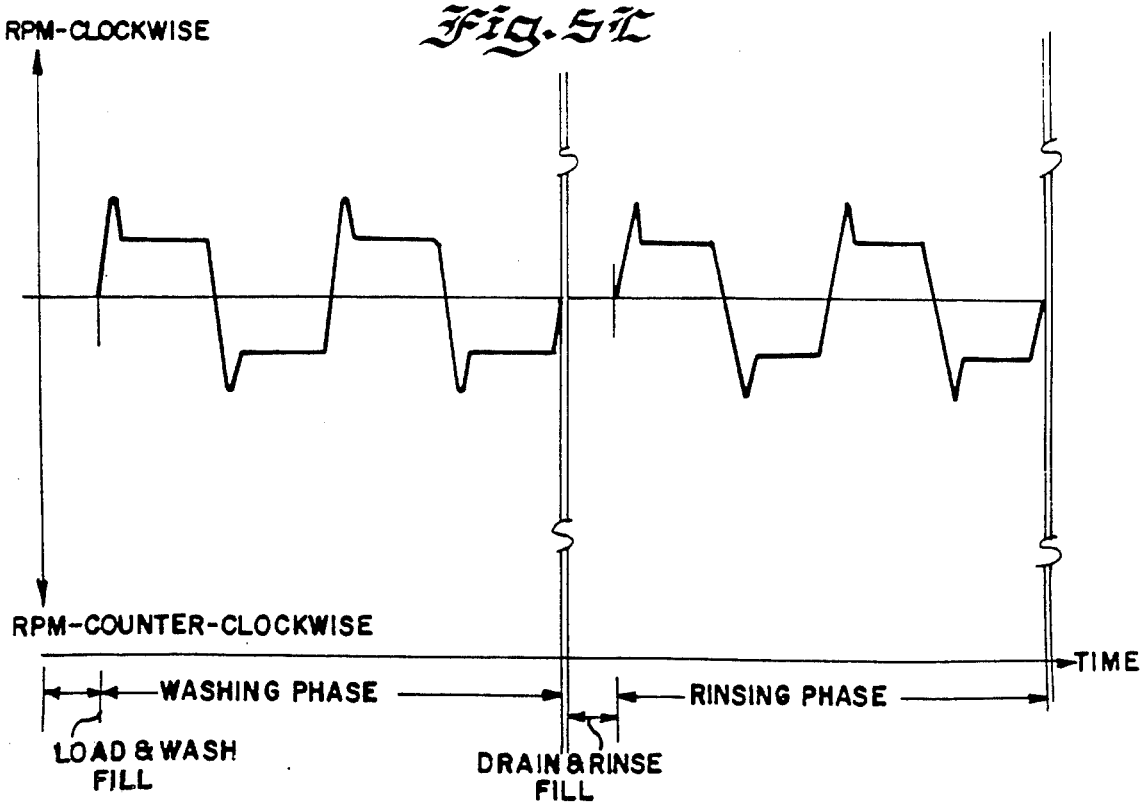
Figure 5D:
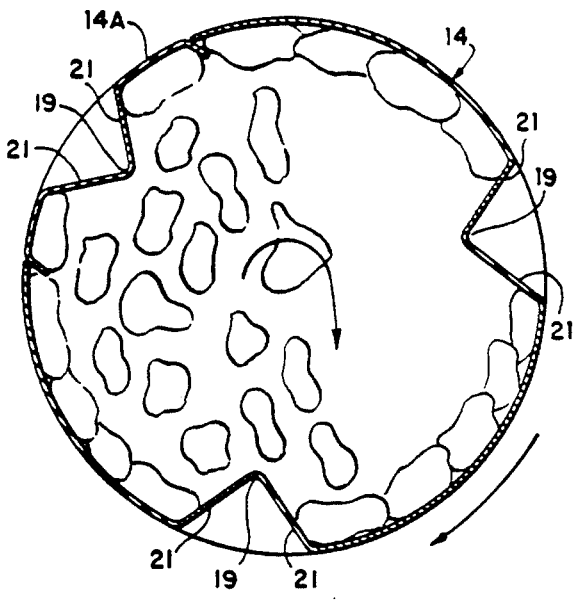
Figure 5E:
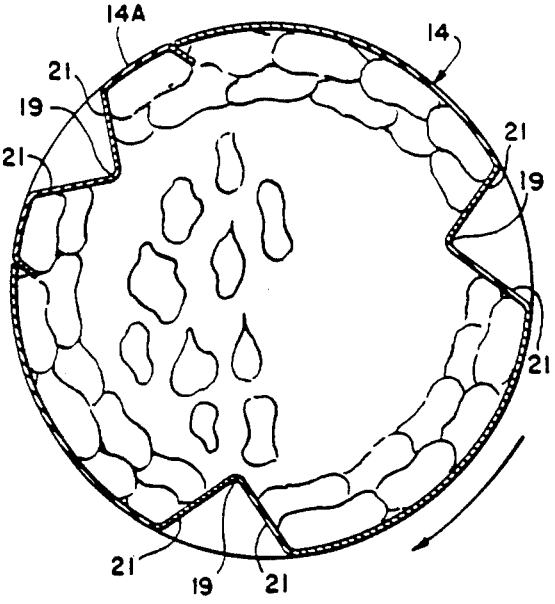
Figure 5F:
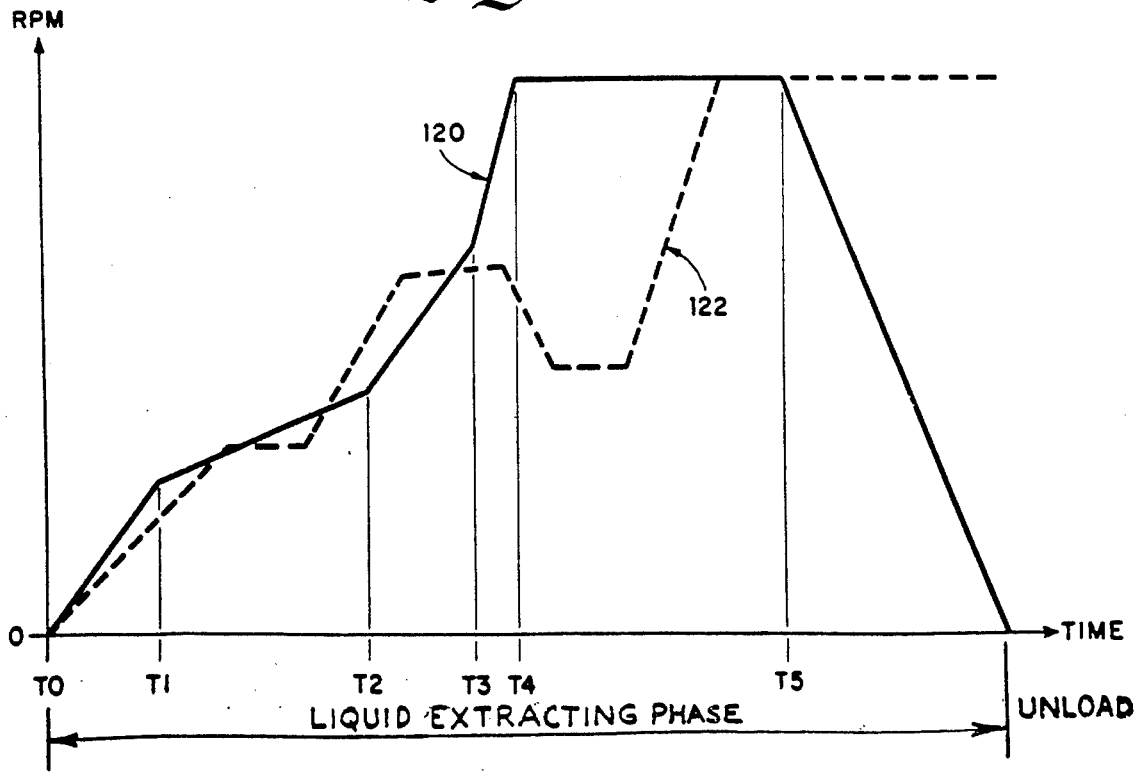
Figure 5A:
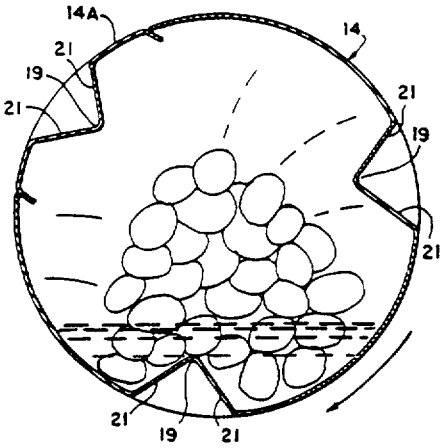
Figure 5B:
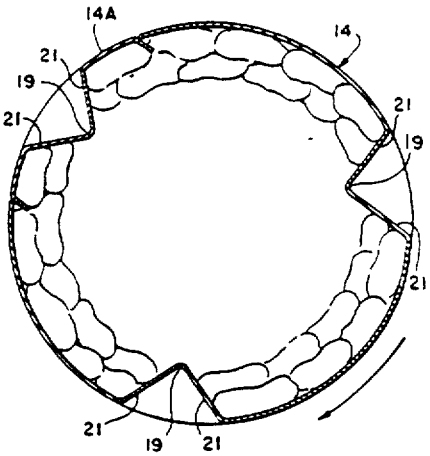
Figure 5C:
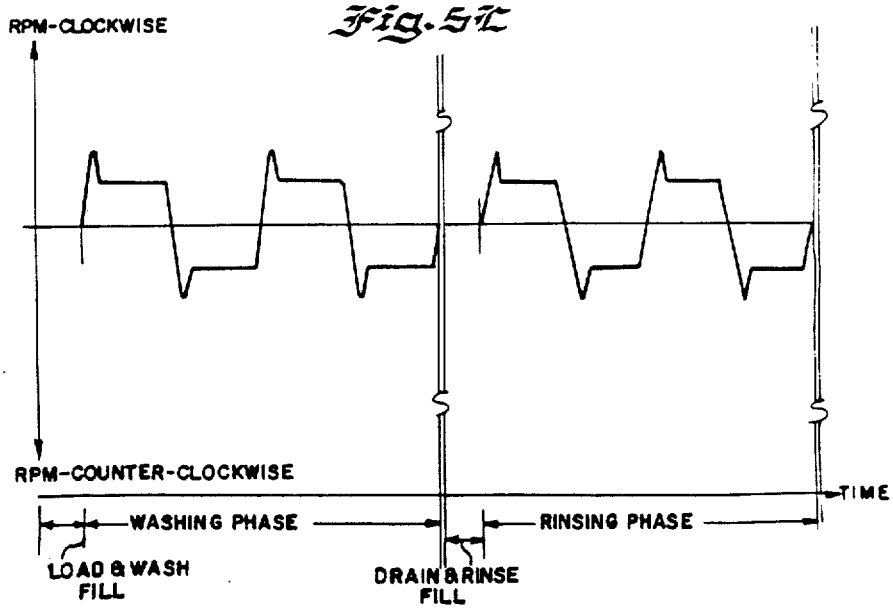
Figure 5D:
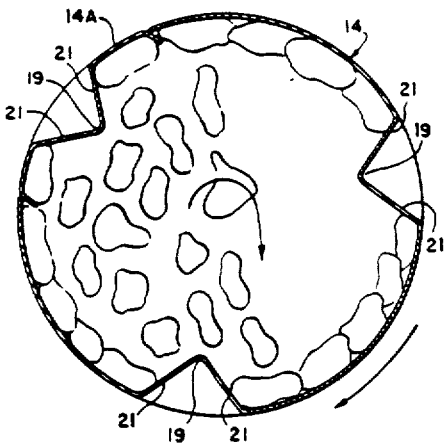
Figure 5E:
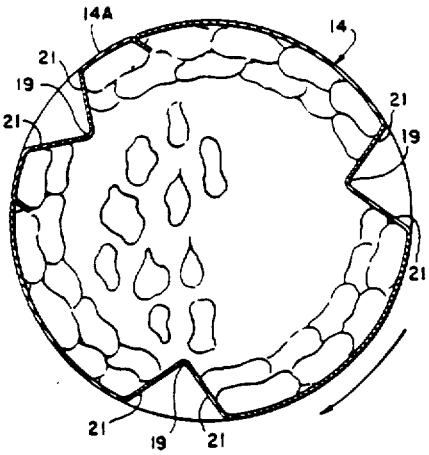
Figure 5F:
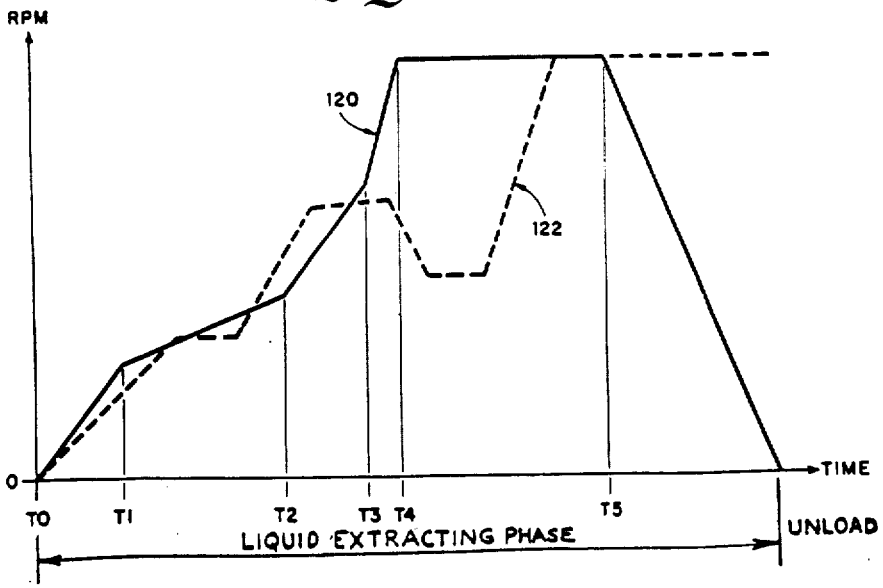
Figure 5:
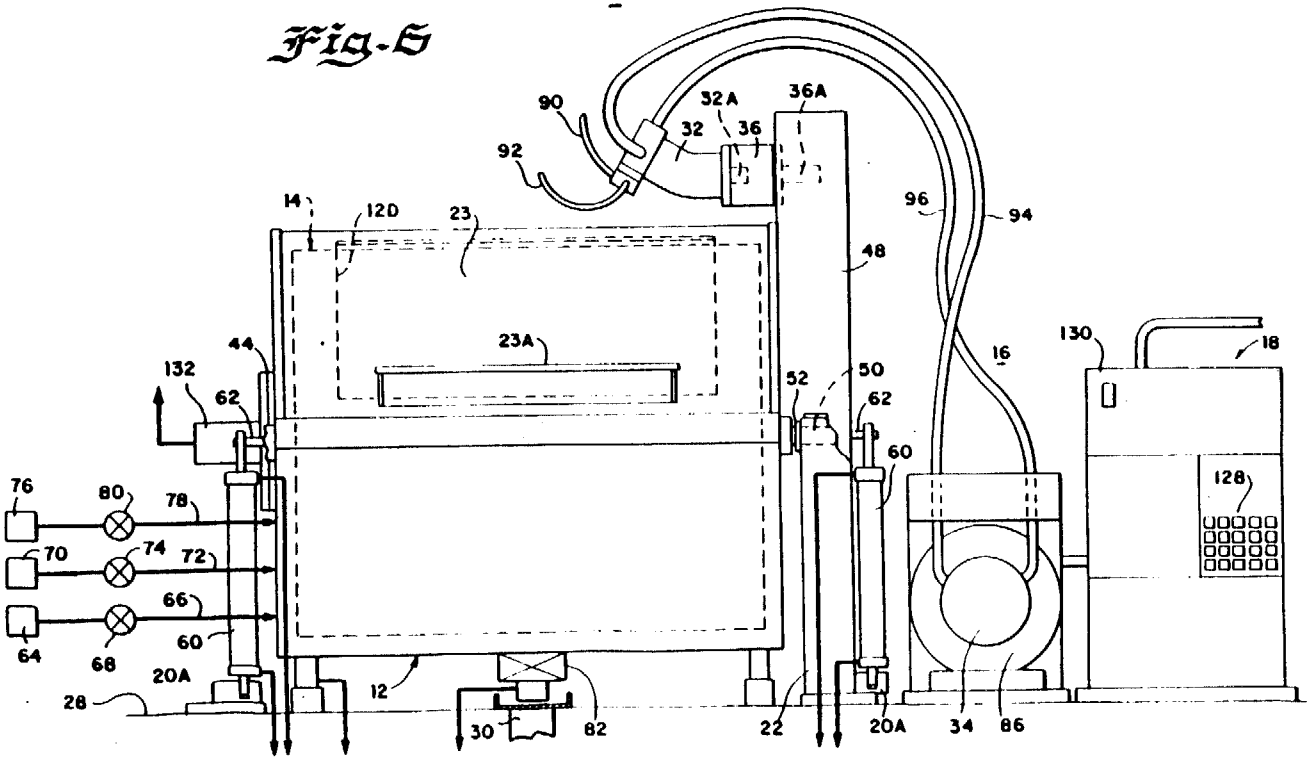

For the purpose of unloading and loading laundry materials into and out of the interior of the perforated laundering cylinder 14, the cylinder is provided with a perforated door section 14A having longitudinal edges 15 adapted to abut and seat within longitudinally extending door jambs or edge members 17 provided on the interior of the laundering cylinder In addition, the cylinder 14 is provided with a plurality of longitudinally extending lift elements or ribs 19 having a generally V-shaped transverse cross-sectional configuration formed by sides 21 sloping inwardly and slanted at approximately 45° to the radial as illustrated in FIGS. 3 and 5.

As illustrated, the sloping side 21 of the ribs 19 are equilaterally disposed to converge at an apex spaced inwardly of the outer peripheral surface of the perforated cylinder 14 and as the cylinder rotates in either direction during a washing cycle at relatively low speed, the laundry materials placed in the drum for cleaning can tumble from the elevating sides 21 of the ribs and fall back into the washing liquid repeatedly to effect the desired washing action. Because the laundering cylinder 14 is bi-directionally rotated during a washing cycle, the slope or slant of the ribs 19 is approximately equal on both sides of the apex and has a relatively shallow angle in the order of 45° as contrasted to greater angles provided in unidirectional rotational type machines. The relatively shallow angle of slope of the ribs 19 permits circumferential movement of the fabric materials during washing and rinsing phases, and during an acceleration portion of the extraction phase so that the load of material can be uniformly and equally dispersed around the entire periphery of the rotating perforated cylinder 14. Steeper slope angles in the order of 60° to 90° tend to inhibit the sliding movement of the fabric materials being washed and tend to cause imbalance in the loading if the initial load is not carefully positioned within the interior of the cylinder. The outer housing 12 includes an enlarged rectangular opening 12D on the front wall and a loading door 23 having a lift handle 23A along the lower edge is provided to slide the door circumferentially on the washing chamber surface to open and close the opening 12D as required As illustrated in FIG. 2, when the handle 23A of the door 23 is moved upwardly in a clockwise direction until it engages cushion members 25, the large size opening 12D is fully exposed in the upper half of the housing 12 so that laundry materials from a laundry conveyor or the like can drop down vertically into the interior of the perforated laundering cylinder 14 which is positioned with its opening aligned with the opening 12D and its door 14A in the fully open position. After a load of laundry materials is deposited in the interior of the laundering cylinder 14 the door 14A is moved circumferentially into the closed position as shown (FIG. 3) and thereafter the outer housing door 23 is similarly moved downwardly to the closed position in a counterclockwise direction to seal the outer washing chamber around the rotor drum during the washing, rinsing and extracting phase. For a precise and detailed description of the door construction, reference should be had to U.S. Pat. Nos. 3,712,090; 3,896,642 and 4,479,371 which patents are incorporated herein by reference.

The housing 12 and laundering cylinder 14 contained therein are supported on a base structure 20 which includes a pair of upstanding support posts 22 at opposite ends of the housing and interconnected by longitudinally extending front and rear channels 24 and 26 (FIG. 2) to form a sturdy rectangular framework which can be mounted on a floor or other support surface 28 having a sump or drain 30 centered below the housing for accommodating the drainage of liquid from the machine 10.

The perforated laundering cylinder 14 is driven to rotate within the housing 12 by a variable displacement hydraulic motor 32 that is hydraulically coupled to a variable displacement hydraulic pump 34 in a closed loop system which will be described in detail with respect to FIG. 4.

An output shaft 32A (FIG. 4) of the variable displacement hydraulic motor is directly interconnected to the input side of a five to one (5:1) gear reducer 36 having an output shaft 36A supporting a multiple belt drive sheave 38 which is drivingly interconnected to a larger diameter driven sheave 40 (FIG. 2) mounted on a stub axle 42 on one end of the perforated laundering cylinder 14 and extending outwardly through a bearing provided on an outer end wall 12A of the housing 12. The sheaves 38 and 40 are drivingly interconnected by a plurality of endless belts 46 and the entire mechanical drive system between the hydraulic motor 32 and the supporting stub drive axle 42 are encased within a protective enclosure 48 detachably secured to the end wall 12A of the cylindrical housing 12.

Referring to FIGS. 2 and 3 a forward side of the housing 12 and components mounted thereon is supported for pivotal movement about a horizontal axis B between a first operative position shown in solid lines during washing, rinsing and extracting phases and a second, loading and unloading position shown in dotted lines wherein the washing chamber and associated components are pivoted upwardly about the axis B in a counterclockwise direction so that the fabric materials 12 may be loaded into or removed from the rotor drum and housing. For this purpose, the housing 12 is provided with a pair of stub axles 50 projecting outwardly from opposite circular end walls 12A and 12C and these stub axles are journalled in bearing sleeves 52 mounted on the front end portion of the end supports 22 of the base 20 as shown in FIG. 2. On the back side of the housing 12 there is provided a pair of outwardly projecting stub axles 54 carried on brackets 56 extending outwardly from the circular end walls 12A and and 12C. The stub axles 54 are designed to rest and be supported in suitable bearing structures 58 also mounted on the end supports 22 of the base structure 20 adjacent the rearward end portion thereof as best shown in FIGS. 1, 2 and 3. The bearings 58 are of semi-cylindrical shape so that the axles 54 may freely pivot upwardly away from the bearings whenever the housing 12 and laundering cylinder 14 are moved from the operative position to an unloading position.

In order to maintain the stub axles 54 seated within the bearings 58 during operation and in order to permit pivoting of the housing 12 and associated components upwardly for loading and unloading, the washing and extracting machine 10 includes a pair of hydraulic tilt cylinders 60 mounted at opposite ends of the chamber. The lower end of each tilt cylinder 60 is pivotally journalled on a bracket 20A on an end support 22 and the upper or rod end of the cylinders are pivotally interconnected to short stub axles 62 projecting outwardly from opposite ends 12A and 12C of the washing chamber spaced forwardly eccentric of the center axis A of rotation of the inner perforated cylinder. When the lower ends of the tilt cylinder 60 are supplied with pressurized hydraulic fluid the cylinder rods are extended outwardly as shown in FIG. 2, dotted lines, to tilt the housing 12 upwardly in a counterclockwise direction about the pivot axis B to the upper loading and unloading position as shown in dotted lines. Subsequently, after loading or unloading has been accomplished, the hydraulic pressure in the lower ends of the tilt cylinder 60 is reduced and the cylinder rods are withdrawn back into the cylinders to pivot the drum downwardly in a clockwise direction back to the lower, operating position as shown in solid lines in readiness for a next operating cycle. Pressure is maintained on the upside of the piston in the hydraulic cylinders 60 during an operating cycle so that the stub axles 54 are positively retained in the semi-cylindrical bearings 58 even though slight imbalance forces may occur during rotation of the laundering cylinder 14 and the loading of fabric material and washing liquid contained therein.

Figure 6:
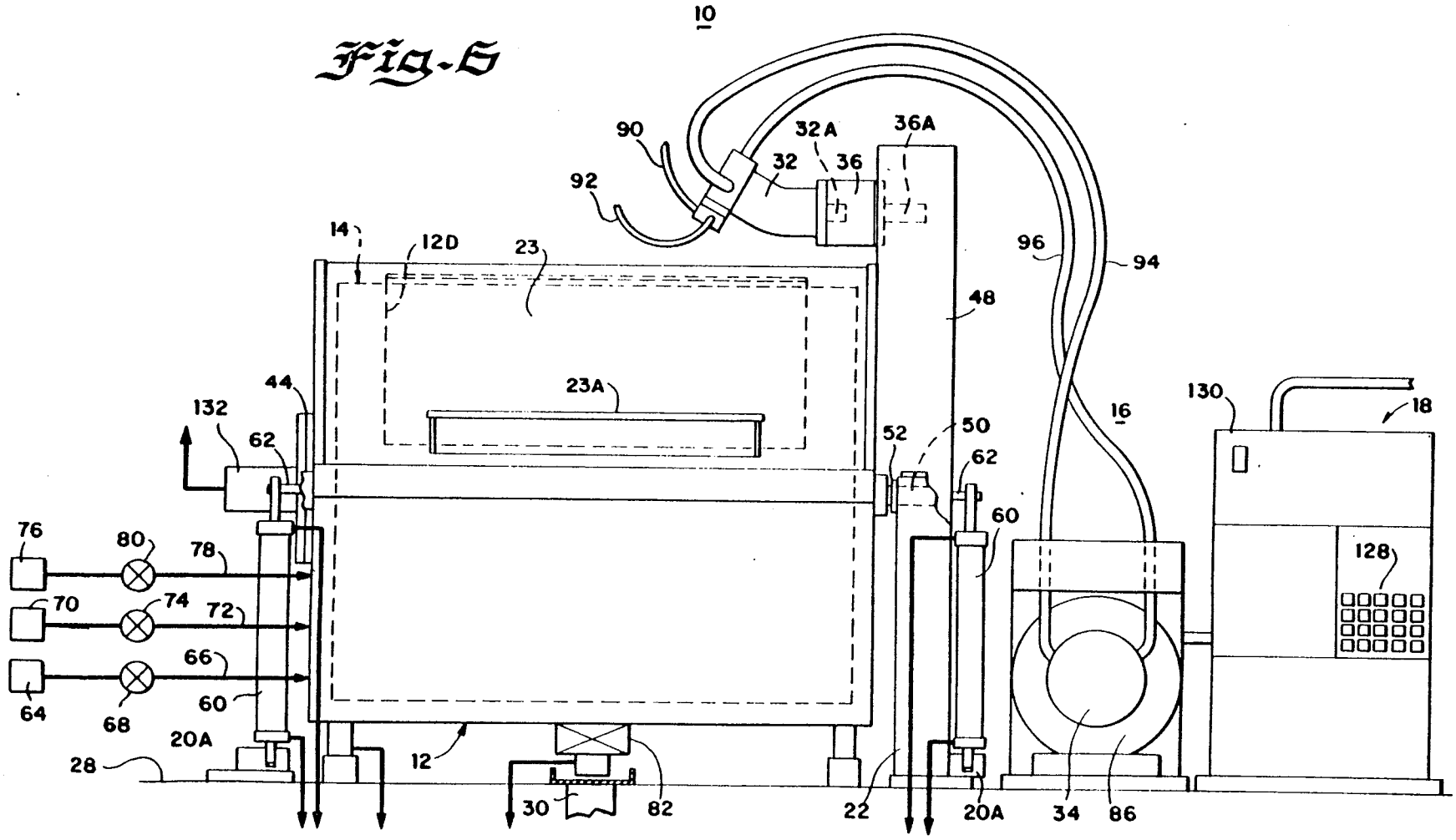
FIG. 6 is a schematic elevational diagram of the washing and extracting machine illustrating associated drive and component elements used therewith for operation of the machine.
Figure 1:
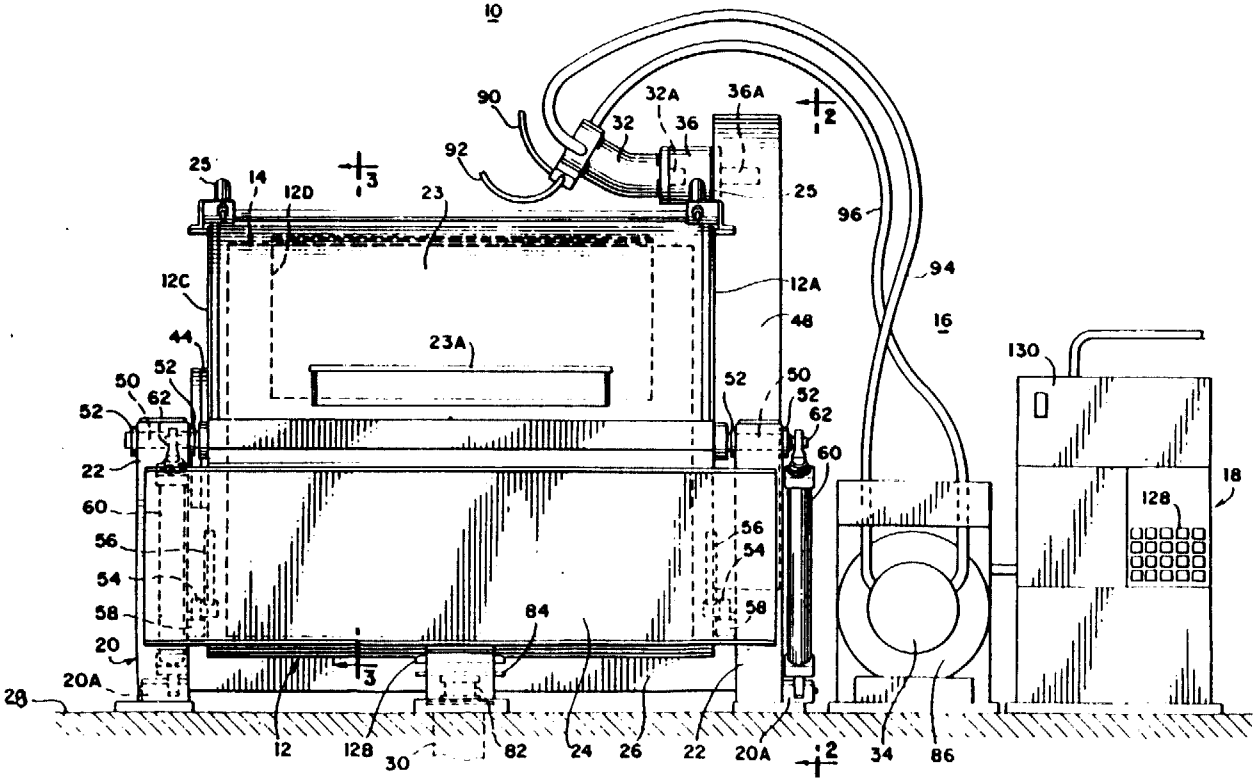
Figure 3:
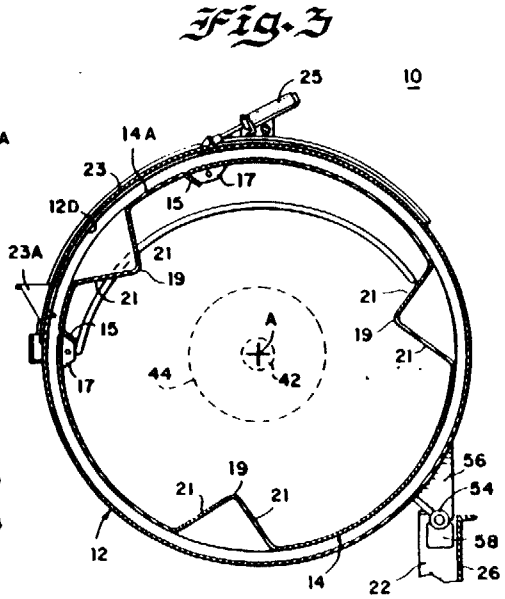
Figure 2:
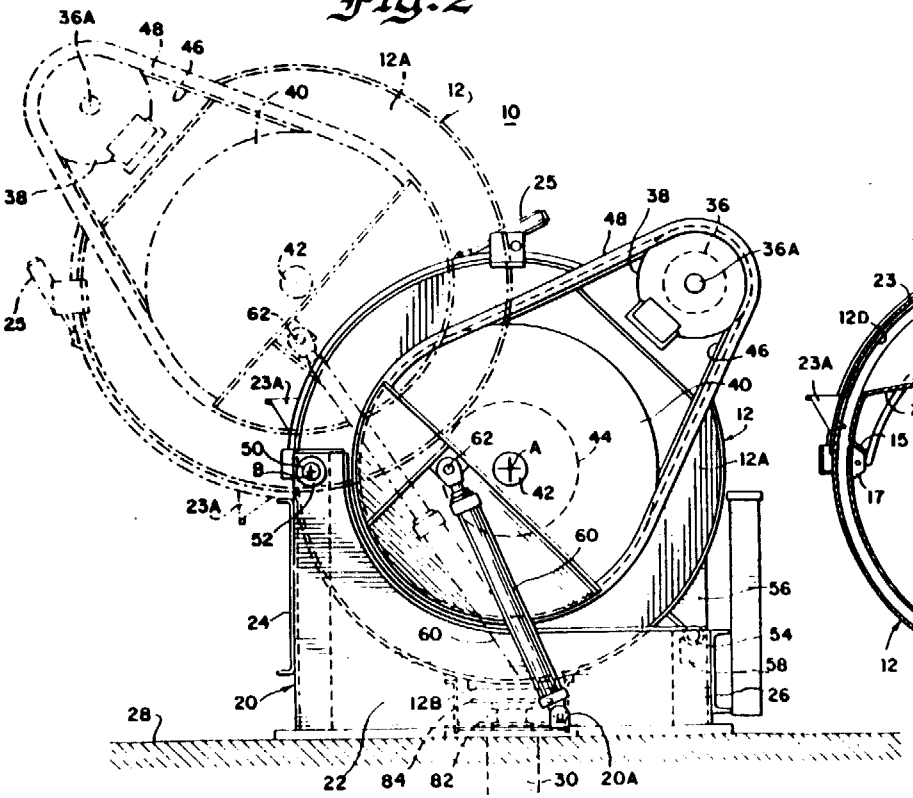
Figure 4:
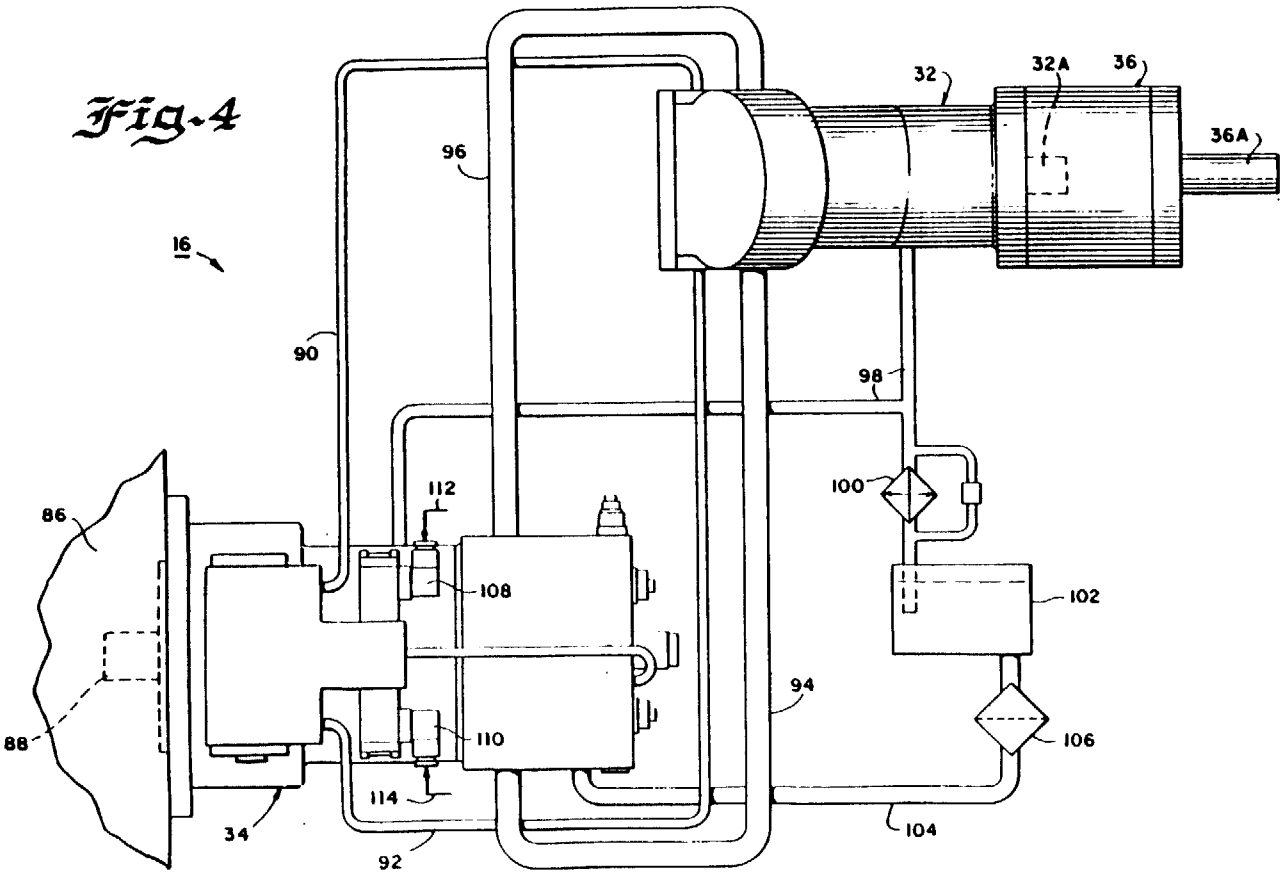
Figure 7:
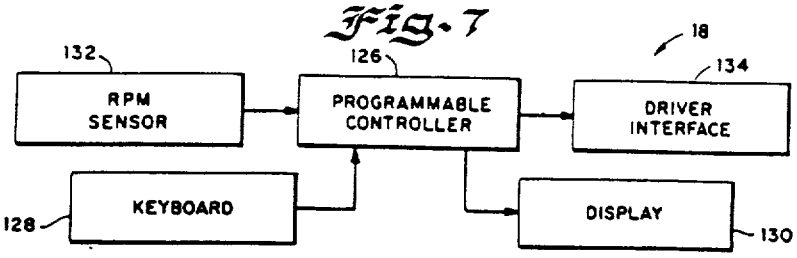
Figure 8:
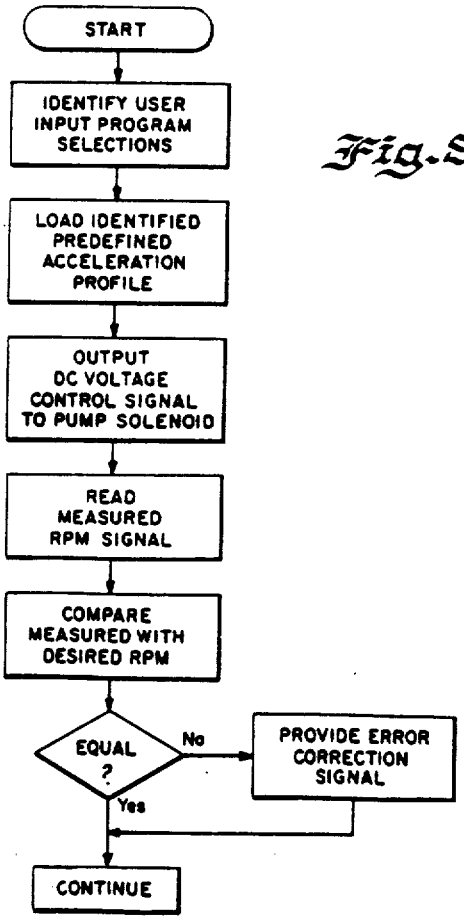

The washing and extracting machine 10 is arranged for sequential programmed operations under a program entered into the programmable controller 18 by the user operator. As indicated in FIG. 6 make up washing liquid for use in washing fabric materials placed in the cylinder 14 is supplied in a controlled manner to the housing 12 and the make-up liquid for each cycle of operation may contain a quantity of a first chemical such as liquid bleach supplied from a tank 64 through a line 66 and adjustable control valve 68. A quantity of a second chemical such as liquid detergent is similarly supplied from a detergent tank or source 70 through a line 72 and adjustable control valve 74. A major portion of the washing liquid comprises hot water at suitable water temperature supplied from a hot water source or tank 76 by a supply line 78 and controlled by a hot water control valve 80.

The quantity and make up of the washing liquid supplied to the housing 12 for each load of laundry material is determined in accordance with the type of material, sizes of the pieces, type of fabric and weight of the load and the precise formulation desired is readily controllable and adjustable by varying the water temperature as well as the percentage and type of detergent and bleach that are provided. The respective control valves 68, 74 and 80 may be utilized for providing the desired washing liquid make up and suitable electronic timers in conjunction with these valves provide for precise repetitive accuracy for similar types of materials and loading ratios. These variables may be changed and programmed into the operating cycle by the user operator by entry of the selections into the programmable controller 18. At the end of an operational washing phase, the washing liquid which has collected in the lower portion of the housing 12 is drained out of the chamber into the floor drain 30 and for this purpose a drain valve 82 is provided including an electrically controlled valve member 84 which is movable to open and close with respect to a lower drain outlet 12B on the lower central portion of the housing 12.

When the bulk of the washing liquid has been drained after completion of a washing phase of the laundering cycle, the drain outlet is closed, rinsing liquid such as plain water is introduced into the housing 12 through a line 79 and control valve 81. The washing and extracting machine 10 then commences a rinsing phase of operation wherein the laundering cylinder 14 is driven to rotate in opposite directions in short sequences similar to the operation during the washing phase. During the rinsing phase, the laundry materials in the cylinder 14 are repeatedly flushed with rinse water at a relatively cold temperature to remove any remnants of detergent or bleach remaining over from the washing liquid.

Figure 4:
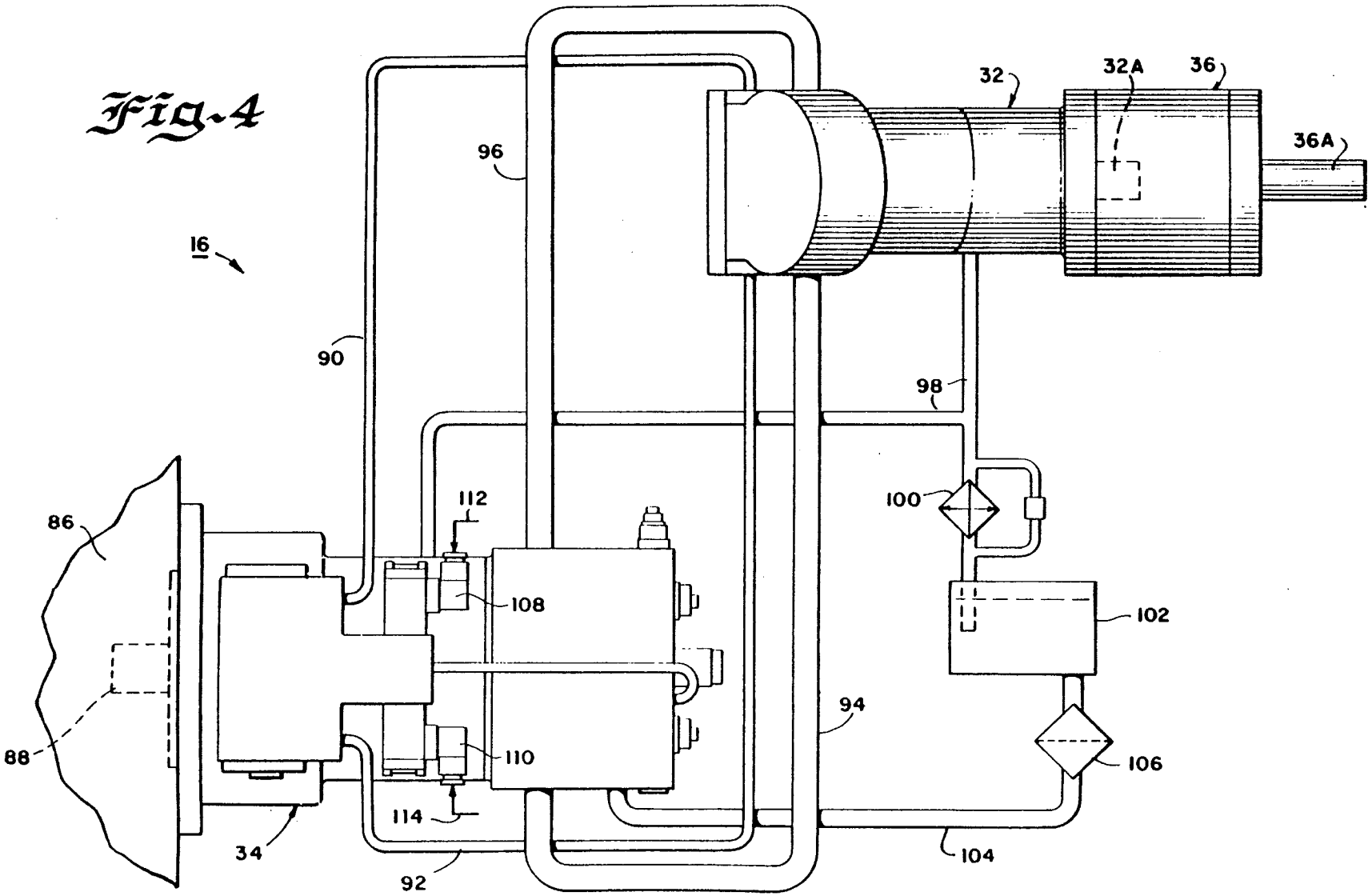
FIG. 4 is a schematic diagram representation of a hydraulic drive system of the washing and extracting machine constructed in accordance with the features of the present invention.

Referring now specifically to FIG. 4, a closed loop type hydraulic drive system 16 for the washing and extracting machine 10 is schematically shown. The hydraulic drive system 16 includes an electric motor 86 that is directly connected to an input drive shaft 88 of the variable displacement pump 34. The electric motor 86 can be rated for example at 30 HP for a cylinder and load of typical commercial size. F-11 series of hydraulic pumps and motors manufactured by the Rexroth Company can be advantageously utilized for the variable displacement motor 32 and the pump 34, such as a Rexroth Model F11-110 having a maximum displacement rating of 6.72 cu in/rev., a maximum continuous power output rating of 195 HP, and a bi-directional, self-priming pump speed of 1,450 RPM. The variable displacement pump 34 includes a multiple piston, axial swash plate design having a hydraulic control and a speed dependent type DA stroking device. The variable displacement motor 32 may be a multiple piston, bent axis design with a hydraulic control, and speed dependent stroking device DA.

The variable displacement pump 34 is hydraulically coupled to the variable displacement drive motor 32 via a pair of control lines 90 and 92 and a pair of working lines 94 and 96. The pump 34 and motor 32 are also connected via a tank connection line 98 and a heat exchanger 100 to a tank or reservoir 102. A suction line 104 couples the variable displacement pump 34 and the reservoir 102 through a filter 106. The variable displacement pump 34 includes a pair of solenoids 108 and 110 that are alternately energized for reversing the flow of oil to the variable displacement motor 32 to reverse the direction of rotation of the laundering cylinder 14. An analog DC control signal is applied to the solenoid 108 via a line 112 for controlling the direction and flow rate of pressurized hydraulic fluid between the pump and motor and thereby control the speed of clockwise rotation of the laundering cylinder 14. Similarly, an analog DC control signal is applied to the solenoid 110 via a line 114 for controlling the speed of counterclockwise rotation of the laundering cylinder 14. During the washing and rinsing phases, the laundering cylinder 14 is rotated at a relatively low speed, such as, for example, in a range between 20–50 RPM and the direction of rotation of the laundering cylinder 14 is periodically reversed Referring now to FIGS. 5A, 5B and 5C, in accordance with the present invention, the hydraulic drive system 16 is programmed to commence a washing phase of operation after loading of the laundry materials has been completed and the proper volume of washing liquid has been dispensed into the housing 12. The laundering cylinder 14 is rapidly accelerated in one direction (i.e., clockwise) to a speed of 40–50 RPM, which speed produces G forces greater than 1G adjacent the periphery of the cylinder. This action is effective to rapidly move or "explode" the laundry materials and laundering liquid adjacent the central portion of the cylinder toward the periphery thereof and as this occurs the washing liquid is forced at high velocity through the fabric of the laundry material to provide excellent washing action and removal of soil therefrom. Upon reaching a speed value producing in excess of 1G at the periphery of the cyliner 14, the hydraulic drive is then activated to rapidly reduce the RPM of the cylinder to a value of 26–30 RPM which provides a force of approximately 1G on the laundry materials around the periphery of the drum. This speed value is maintained relatively constant for a short period of time (for example - 10 to 15 seconds) and the speed is then rapidly dropped off to zero at a high rate of deceleration. As this occurs the laundry material and liquid tends to return toward the central portion of the cylinder 14, which is then rapidly accelerated in a reverse (counterclockwise) direction to an RPM of 40–50 which is a level above the 1G value around the periphery of the cylinder. As this occurs the laundry liquid is again forced rapidly outwardly in a generally radial direction and moves through the fabric of the laundry materials in the cylinder to provide an extremely effective laundering action.

It has been found that greatly improved laundering action is provided by the repetitive succession of reversing stages during a washing phase of operation which may last for a total period of 15–30 minutes. Reversing the direction of cylinder rotation 3 or 4 times every minute and providing rapid acceleration and deceleration as depicted graphically in FIG. 5C, provides a highly efficient laundry process which does not produce excessive unbalanced load on the housing and cylinder supporting structures. As illustrated in FIG. 5C, the "spiked" pattern of operation well above the RPM value needed to provide a 1G force at the periphery of the cylinder, is especially effective to rapidly distribute the load of laundry material and liquid to a substantially uniform density around the entire periphery of the cylinder 14.

It has also been ascertained that, the hydraulic drive system 16 has an effective capability for rapidly accelerating the cylinder 14 and a load contained therein during the low RPM range, reversing cycles, during the washing and rinsing phases of the laundering operation as well as providing the needed high values of torque for the controlled acceleration of the cylinder and its load to a relatively high RPM, extraction phase of operation wherein the remaining liquid in the cylinder is effectively extracted.

Moreover, the reversing, spike pattern, of RPM versus TIME as illustrated graphically in FIG. 5C is believed to produce the improved laundering action with a minimum of energy being expended and with a minimum of unbalanced loading on the base and the structures which support the housing 12 and the rotary cylinder 14.

In accordance with the principles of the present invention, an extracting speed of rotation (i.e., 500–600 RPM) of the laundering cylinder 14 is controllably varied in accordance with a predefined acceleration profile that can be selectively provided to accommodate different article characteristics of the laundry materials being handled. FIGS. 5D–5F provide graphical representations illustrating a typical extracting cycle of the washing and extracting machine 10. In the graphical representation of FIG. 5F, an exemplary predefined acceleration profile is designated by the reference numeral 120 with speed along a vertical axis labeled RPM and time along a horizontal axis labeled TIME.

FIGS. 5D and 5E, respectively, illustrate a first and a second stage of positioning of the laundry materials within the cylinder 14 during acceleration of the cylinder in an extracting phase of a machine operating cycle. In a first stage (FIG. 5D) of extraction after a washing and rinsing phase is completed, a first portion of laundry materials "sticks" or is maintained in a generally balanced layer extending around the entire periphery of the cylinder 14. This first stage of the extraction cycle corresponds to, for example, the illustrated rotational speed of about 26–30 RPM of the cylinder 14 at a time T1 on the acceleration profile 120. A centrifugal force at the cylinder periphery is approximately 1G during this first stage.

As the cylinder 14 is accelerated to a second speed, for example, about 60 RPM within the time period between T1 and T2, a second stage (FIG. 5E) of liquid extraction from the laundry materials takes place and results in an additional second layer of materials maintained in a generally balanced condition around the periphery of the cylinder 14, as shown. A centrifugal force at the radius of the second layer is approximately 1G during this second stage of the acceleration profile 120. The cylinder 14 is further accelerated to a third stage, for example, about 220 RPM within the time period between T2 and T3 with the laundry materials moving circumferentially around the drum to form additional layers of material distributed more or less uniformly around the periphery of cylinder 14. During the time period between T3 and T4, the cylinder 14 is more rapidly accelerated to a maximum extracting speed, such as, for example, 530 RPM, and in this fourth stage of extraction, substantially all of the laundry materials are maintained in a generally uniform density layer about the entire periphery of the cylinder 14. The cylinder 14 is then rotated at the maximum extracting speed for a preselected time period between T4 and T5.

A second exemplary predefined acceleration profile is shown in the dotted line of FIG. 5F designated in its entirety by the reference numeral 122. This type of extraction profile can be selectively provided for the extracting cycle of the washing and extracting machine 10, for example, for a different type of laundry material such as rubber mats or the like which are relatively smooth surface and have low value of surface friction between separate mats sliding over one another.

In the acceleration profile 122, the cylinder 14 is accelerated within selected time periods to first and second higher speeds that are each maintained for selected periods. Then the cylinder 14 is deccelerated to a third speed that is lower than the second speed for a period of time prior to a final acceleration to the maximum extracting speed. Acceleration profiles are defined to optimize the performance of the washing and extracting machine 10 with different types of laundry materials.

For example, when a batch of relatively small size hand towels made of synthetic fabric are to be cleaned, these items are relatively slippery and slide around easily in a circumferential path in the rotating cylinder to rapidly fill into areas of reduced concentration of materials around the periphery of the cylinder 14. Accordingly, a faster acceleration rate can be utilized and a shorter time interval may be alloted for the accumulation of a uniform thickness layer of hand towels around the periphery of the cylinder before the cylinder is rapidly accelerated to a much higher speed for the bulk of the extraction of the washing liquid.

During acceleration of the washing cylinder as each towel is subjected to centrifugal force of approximately 1G, the towels will no longer fall from the top of the circular orbiting path adjacent the periphery of the cylinder 14 but instead will remain in substantially the same layer or position relative to the axis rotation throughout each revolution. Towels in the outer layer of material in the rotating cylinder are subject to higher G forces during rotation than those towels which are positioned inwardly thereof toward the axis of rotation.

Accordingly, as rotation speed increases, the towels in the outer layer begin to stick in a particular position adjacent the cylinder wall somewhat before those towels which are positioned radially inwardly thereof. These inwardly spaced towels are still able to move circumferentially around the drum to seek thinner portions of the layer and filling these voids to provide a substantially uniform thickness layer of laundry materials around the entire circumference of the rotating cylinder.

If the acceleration rate is too great, the towels may be held in fixed position circumferentially and cannot migrate around the drum to provide a uniform thickness layer of material which is the reason that greatly reduced unbalanced loading force can be achieved. It is also to be understood that, certain types of materials being laundered have greater frictional characteristics than others and will not migrate around the rotating cylinder as readily while being subjected to radial G forces in the range of 1 G to slightly above. For these types of materials, a longer period of dwell or constant speed rotation at a lower speed level may be required to provide a uniform thickness layer in the cylinder before the cylinder is rapidly accelerated to a maximum RPM extraction speed.

It should also be noted that, the size and weight characteristics of the materials being laundered also is an important factor in determining the optimum acceleration pattern to go from a washing cycle to the liquid extraction phase. Larger pieces such as sheets, and heavier pieces such as towels, do not slide over one another as readily as smaller and lighter laundry items. Accordingly, the initial acceleration rate may be decreased and these materials may require a longer period of constant, low RPM rotation before acceleration of the drum up to maximum extraction speed can be successfully accomplished without excessive unbalanced loading of the drum.

Moreover, in some cases, it may be necessary to reduce the RPM of the rotating cylinder after initial acceleration from the washing/rinsing phase speed and a short constant RPM holding period has been accomplished for the purpose of helping to reduce the thickness of certain portions of the material in the cylinder wherein inadvertent concentration has occurred because of uneven loading or other factors.

Once a successful acceleration pattern has been identified for a selected type of laundry material, the programmable controller can be utilized to provide repeatable performance for success loads of the same. After experience has been obtained with a wide variety of different types of materials, a family of acceleration profiles can be established that is useful for almost any type of material to be encountered.

Figure 7:
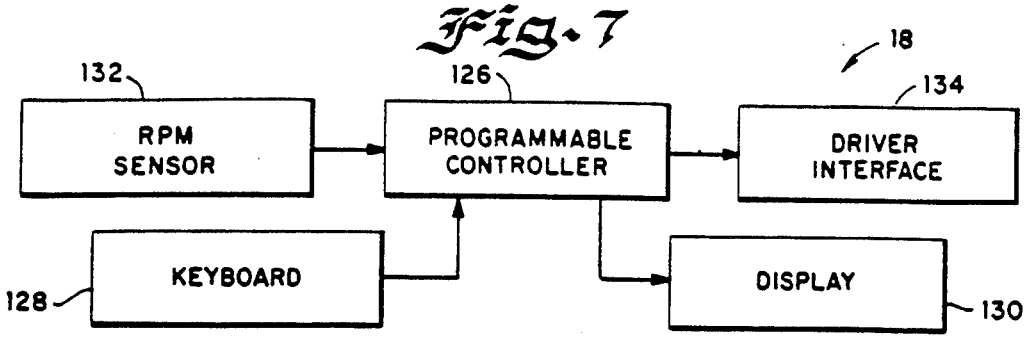
FIG. 7 is a schematic block diagram representation of a programmable controller system used for controlling the washing and extracting machine.

Referring to FIG. 7, there is shown a block diagram representation of the programmable controller system 18 of the washing and extracting machine 10 including a programmable controller 126 which includes a processor for performing sequential logical operations under program control and memory for storing user selections and the operating program of the processor. Various commercially available programmable controllers having standard capabilities can be employed for the programmable controller 126, such as, for example, a General Electric, programmable controller GE Series 1+that includes an analog output. A keyboard 128 is employed for receiving user operator program selections including a data selection indicative of a laundry material type. A display 130 is provided for displaying instructions and operating parameters for viewing by the user operator. A speed (RPM) sensor 132 senses the speed of rotation of the laundering cylinder 14 and applies a signal representative thereof to the programmable controller 126. The programmable controller 126 performs logical operations in accordance with the user selections and stored program and generates outputs which either directly or by an interface driver 134, activate and deactivate the machine functions. The controller 126 is operable to control machine apparatus such as the filling valves 68, 74, 80 and 81, the drain valve solenoid 82, the hydraulic tilt cylinders 60 and most importantly, the solenoids 108 and 110 of the hydraulic drive system 16.

Figure 8:
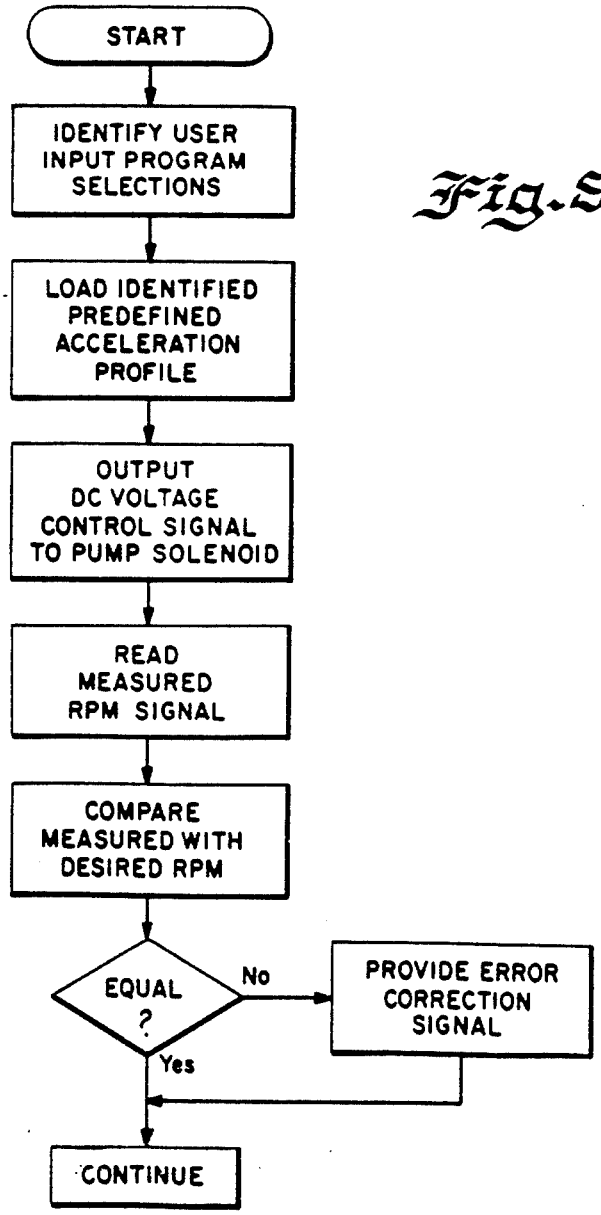
FIG. 8 is a flow chart of the programmable controller in accordance with the present invention.

FIG. 8 provides a flow chart illustrating the logical steps performed by the programmable controller 126 during an extracting cycle in accordance with the invention. First, a user operator input selection indicative of a particular type of laundry material is identified. Then an optimum one of a plurality of predefined acceleration profiles, for example, from a stored history table within the memory of the programmable controller 126 is identified for the particular laundry material type. An analog control signal is generated and applied to one of the solenoids 108 or 110 corresponding to the thus identified acceleration profile.

A measured RPM signal output of the RPM sensor 132 is employed to compare the actuator measured rotational speed of the cylinder 14 with a desired speed thereof. When the measured and desired signals are not equal, an error correction signal is then provided to the pump solenoid.

Although the present invention has been described in connection with details of the preferred embodiment, many alterations and modifications may be made without departing from the invention. Accordingly, it is intended that all such alterations and modifications be considered within the spirit and scope of the invention as defined in the appended claims.

What is claimed is:

1. A method of laundering a plurality of different types of laundry materials loaded in a rotatable cylinder having a drive mechanism for rotating the cylinder at a variable speed, said method comprising the steps of:

storing a plurality of predefined acceleration profiles, each said predefined acceleration profile including a plurality of predetermined time intervals for varying the rotational speed of said cylinder between predetermined first and second speeds for each of said time intervals, thereby to accelerate said laundering cylinder at a predetermined rate within each of said time intervals;

identifying a particular one of said laundry materials to be laundered;

identifying one of said stored predefined acceleration profiles responsive to said identified laundry material; and controlling said drive mechanism to vary the rotational speed of said cylinder in accordance with said identified predefined acceleration profile.

2. The method of claim 1, comprising the additional steps of:

rapidly accelerating the rotational speed of said cylinder to a speed value greater than that required to maintain a force of 1G on said materials positioned adjacent the periphery of said rotating cylinder; and thereafter rapidly decelerating the rotational speed of said cylinder to a substantially lesser speed value.

3. The method of claim 2, comprising the additional steps of:

thereafter maintaining said lesser speed value of said rotating cylinder for a selected interval of time; and thereafter decelerating the rotational speed of said cylinder at a rapid rate toward zero.

4. The method of claim 3, comprising the additional steps of:

thereafter rapidly accelerating the rotational speed of said cylinder in an opposite direction to a speed value greater than that required to maintain a force of 1G on said material positioned adjacent the periphery of said rotating cylinder; and thereafter rapidly decelerating the rotational speed of said cylinder to a substantially lesser speed value.

5. The method of claim 4, including the additional steps of:

thereafter maintaining said lesser speed value of said rotating cylinder for a selected interval of time; and thereafter decelerating the rotational speed of said cylinder at a rapid rate toward zero.

6. The method of claim 5, including the additional steps of:

draining off said washing liquid from said cylinder; and thereafter accelerating said cylinder to a liquid extraction speed in accordance with said predefined acceleration profile in an extraction phase for extracting by centrifugal action any remaining liquid from said materials in said cylinder being laundered.

7. The method of claim 6, including the additional steps of:

maintaining said rotating cylinder at a relatively high speed in said extraction phase for a predetermined period of time; and thereafter decelerating said rotational speed of said cylinder toward a lower value in preparation for unloading of said material laundered in said cylinder.

8. The method of claim 1, comprising the additional steps of:

rotating said cylinder with said materials and liquid therein at a speed suitable for moving the liquid through the materials for washing and/or rinsing thereof;

accelerating said cylinder to a rotational speed higher than said washing/rinsing speed for rapidly extracting said liquid from said materials and said cylinder by centrifugal force; and decelerating said cylinder to a lower speed after said rapid extracting of said liquid.

9. The method of claim 8, wherein:

said accelerating step is followed immediately by said decelerating step.

10. The method of claim 8, wherein:

said cylinder is in communication with a drain for removing said liquid during said acceleration step.

11. The method of claim 8, wherein:

said cylinder is rotated for a selected time period at said higher rotational speed following said acceleration step and before said deceleration step.

* * * * *

UNITED STATES PATENT AND TRADEMARK OFFICE
CERTIFICATE OF CORRECTION

PATENT NO. : 4,916,768

DATED : April 17, 1990

INVENTOR(S) : John Broadbent

It is certified that error appears in the above-identified patent and that said Letters Patent is hereby corrected as shown below:

The title page should be deleted to appear as per attached title page.

The sheets of Drawing consisting of Figs. 1-13, should be added as per attached sheets.

This certificate supersedes Certificate of Correction issued April 29, 1991.

Signed and Sealed this

Seventeenth Day of December, 1991

*Attest:*

HARRY F. MANBECK, JR.

*Attesting Officer*

*Commissioner of Patents and Trademarks*

United States Patent [19]

Broadbent

[11] Patent Number: 4,916,768

[45] Date of Patent: Apr. 17, 1990

[54] WASHING AND EXTRACTING METHOD

[75] Inventor: John Broadbent, Bloomingdale, Ill.

[73] Assignee: Ellis Corporation, Itasca, Ill.

[21] Appl. No.: 346,567

[22] Filed: May 2, 1989

Related U.S. Application Data

[62] Division of Ser. No. 130,311, Dec. 8, 1987, Pat. No. 4,856,301.

[51] Int. Cl.[4] ..... D06F 33/02

[52] U.S. Cl. ..... 8/159

[58] Field of Search ..... 8/159; 68/12 R, 24, 68/148, 152, 153, 171, 172

[56] References Cited

U.S. PATENT DOCUMENTS

| | | | |
|---|---|---|---|
| Re. 23,065 | 12/1948 | Ellis | 68/140 |
| 1,400,977 | 12/1921 | Perry | 68/210 |
| 1,611,895 | 12/1926 | Dienner | 68/140 X |
| 1,856,168 | 5/1932 | Perry | 68/210 |
| 2,115,072 | 4/1938 | Hunt et al. | 51/163.1 X |
| 2,165,884 | 7/1939 | Chamberlin et al. | 8/159 |
| 2,540,717 | 2/1951 | Diether | 68/24 X |
| 2,556,490 | 6/1951 | Chamberlin | 8/159 |
| 2,695,103 | 11/1954 | Armstrong | 68/24 X |
| 3,066,521 | 12/1962 | Gillessen | 68/148 X |
| 3,135,093 | 6/1964 | Hoffman, III . | |
| 3,172,277 | 3/1965 | Burkland | 68/24 X |
| 3,187,524 | 6/1965 | Wolverton | 68/24 |
| 3,197,983 | 8/1965 | Ilmer | 68/24 |
| 3,321,941 | 5/1967 | Ellis | 68/24 |
| 3,359,762 | 12/1967 | Lornitzo | 68/24 |
| 3,381,939 | 5/1968 | Brown et al. . | |
| 3,388,410 | 6/1968 | Marshall | 68/24 |
| 3,405,483 | 10/1968 | Boniface . | |
| 3,407,635 | 10/1968 | Beebe et al. | 68/207 |
| 3,417,582 | 12/1968 | Hertig et al. | 68/210 |
| 3,417,583 | 12/1968 | Hutterer | 68/210 |
| 3,566,627 | 3/1971 | McAnich et al. | 68/24 |
| 3,667,707 | 6/1972 | Mui | 248/638 X |
| 3,712,090 | 1/1973 | Toth et al. | 68/210 |
| 3,896,642 | 7/1975 | Toth | 68/210 |
| 4,513,464 | 4/1985 | Rettich et al. | 8/159 |

FOREIGN PATENT DOCUMENTS

| | | | |
|---|---|---|---|
| 2146351 | 3/1973 | Fed. Rep. of Germany . | |
| 54-119770 | 9/1979 | Japan . | |
| 2129838 | 5/1984 | United Kingdom | 68/24 |
| 2136601 | 9/1984 | United Kingdom . | |

*Primary Examiner*—Philip R. Coe

*Attorney, Agent, or Firm*—Mason, Kolehmainen, Rathburn & Wyss

[57] ABSTRACT

A washing and extracting machine includes a programmable controller for controlling a variable speed drive to control and vary the speed and direction of a rotating laundry cylinder containing a load of materials to be laundered. The cylinder is first loaded and then driven to rotate in a predetermined manner during a washing phase, followed by a rinsing phase and is then accelerated to a relatively high speed for extracting liquid from the laundered materials in an extracting phase. The laundry cylinder is accelerated and/or decelerated in accordance with a changeable, predefined acceleration/deceleration profile so that the laundry materials are movable radially and circumferentially in the cylinder in a controlled manner substantially eliminating unbalanced loading of the cylinder and contents during the washing, rinsing and extracting phases, thus eliminating the need for costly and complex shock mounting systems for supporting the rotating cylinder.

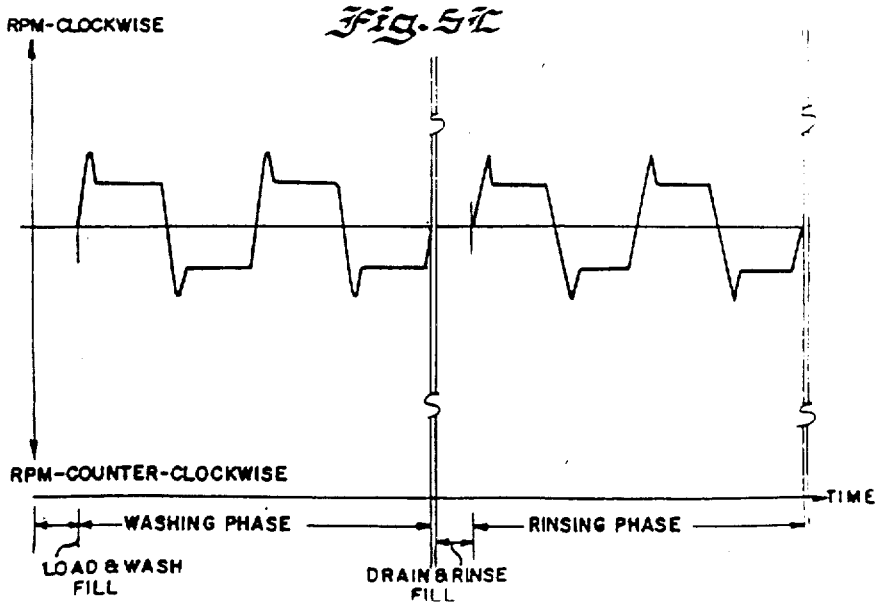

11 Claims, 7 Drawing Sheets